US008373052B2

(12) United States Patent
Yoshino

(10) Patent No.: US 8,373,052 B2
(45) Date of Patent: Feb. 12, 2013

(54) PEDAL APPARATUS

(75) Inventor: Kiyoshi Yoshino, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 20 days.

(21) Appl. No.: 13/151,214

(22) Filed: Jun. 1, 2011

(65) Prior Publication Data

US 2012/0031253 A1 Feb. 9, 2012

(30) Foreign Application Priority Data

Aug. 5, 2010 (JP) ..... 2010-176471

(51) Int. Cl.
*G10D 13/02* (2006.01)

(52) U.S. Cl. ..... 84/411 M; 84/422.1

(58) Field of Classification Search ..... 84/411 M, 84/422.1
See application file for complete search history.

(56) References Cited

U.S. PATENT DOCUMENTS

| | | | | |
|---|---|---|---|---|
| 1,319,994 | A * | 10/1919 | Dorn | 84/422.1 |
| 2,800,828 | A * | 7/1957 | Moeller | 84/422.1 |
| 2,893,284 | A * | 7/1959 | Washington, Jr. | 84/422.1 |
| 4,048,896 | A * | 9/1977 | Calato et al. | 84/422.1 |
| 4,567,808 | A * | 2/1986 | Smith | 84/422.1 |
| 4,817,485 | A * | 4/1989 | Bozzio et al. | 84/746 |
| 5,509,342 | A * | 4/1996 | Augsburger | 84/422.1 |
| 6,063,993 | A * | 5/2000 | Hoshino | 84/422.1 |
| 6,271,450 | B1 * | 8/2001 | Mackie | 84/422.1 |
| 6,392,130 | B1 * | 5/2002 | Carlson | 84/422.1 |
| 6,590,147 | B2 * | 7/2003 | Kassabian | 84/422.1 |
| 6,689,945 | B1 * | 2/2004 | Matsuzoe et al. | 84/422.1 |
| 6,762,354 | B2 * | 7/2004 | Cocca | 84/422.1 |
| 7,396,986 | B2 * | 7/2008 | Packer | 84/422.1 |
| 7,408,104 | B2 * | 8/2008 | Sato | 84/422.1 |
| 7,470,847 | B2 * | 12/2008 | Kitagawa | 84/422.1 |
| 7,601,902 | B1 * | 10/2009 | Lombardi | 84/422.1 |
| 7,897,858 | B1 * | 3/2011 | Liao | 84/422.1 |
| 7,928,305 | B1 * | 4/2011 | Chen | 84/422.1 |
| 2002/0056357 | A1 * | 5/2002 | Kassabian | 84/422.1 |
| 2003/0047060 | A1 * | 3/2003 | Cocca | 84/422.1 |
| 2004/0020345 | A1 * | 2/2004 | Matsuzoe et al. | 84/422.1 |
| 2005/0075218 | A1 * | 4/2005 | Anderson et al. | 482/52 |
| 2005/0120862 | A1 | 6/2005 | Frazier | |
| 2006/0272476 | A1 * | 12/2006 | Packer | 84/422.1 |
| 2007/0044637 | A1 * | 3/2007 | Kjellfren | 84/422.1 |
| 2008/0196574 | A1 * | 8/2008 | Kjellgren | 84/422.1 |
| 2012/0031253 | A1 * | 2/2012 | Yoshino | 84/422.1 |

FOREIGN PATENT DOCUMENTS

| | | | |
|---|---|---|---|
| DE | 44 01 545 | A1 | 5/1995 |
| EP | 0 651 370 | A1 | 5/1995 |
| JP | 07-225581 | A | 8/1995 |

* cited by examiner

*Primary Examiner* — David S. Warren
(74) *Attorney, Agent, or Firm* — Foley & Lardner LLP

(57) ABSTRACT

A pedal apparatus that suppress the generation of acoustic sound at the time of operation includes a belt member made of an elastic material linked to an upright section of a main body section and a belt fastening section of a pedal. When the pedal is stepped on by a performer, the belt member is tensioned from a relaxed state and displaced to a linear form while being subjected to elastic deformation. When the pedal is further stepped on from that state, the displacement of the pedal is limited by the tensile force of the belt member. Accordingly, the generation of the striking sound that would otherwise be produced due to the impacting of bodies against each other to limit the pedal displacement can be avoided.

20 Claims, 6 Drawing Sheets

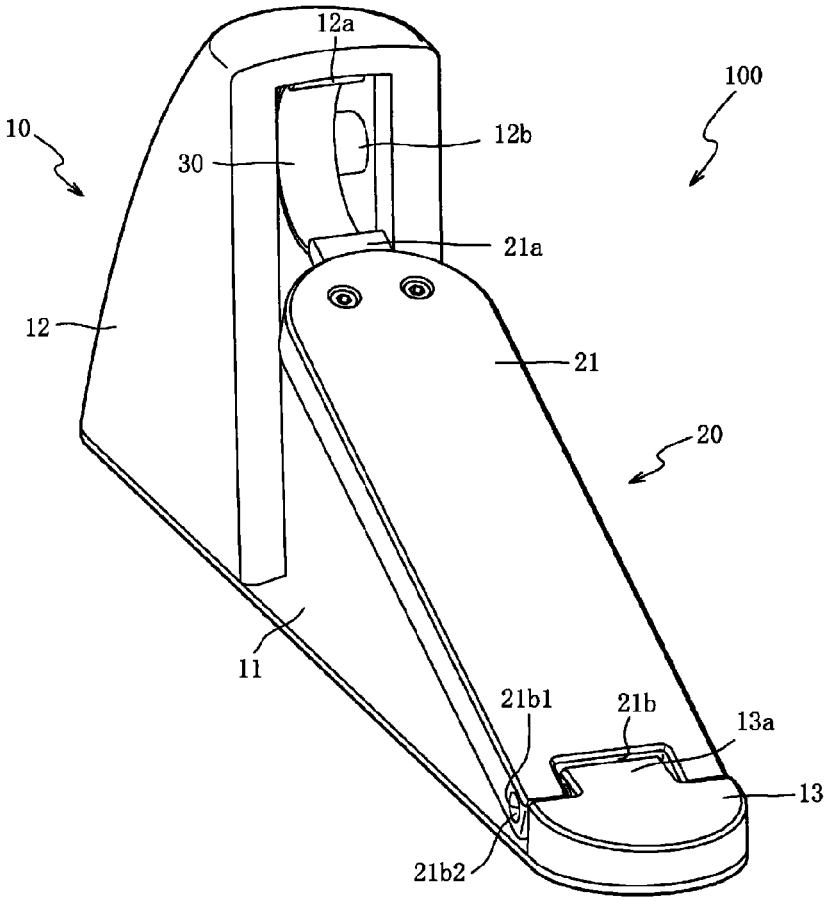
FIG. 1( a )
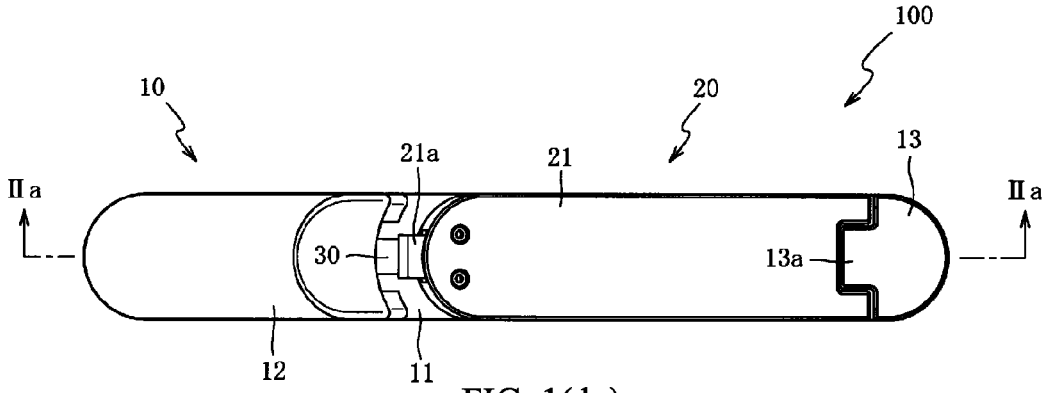
FIG. 1( b )

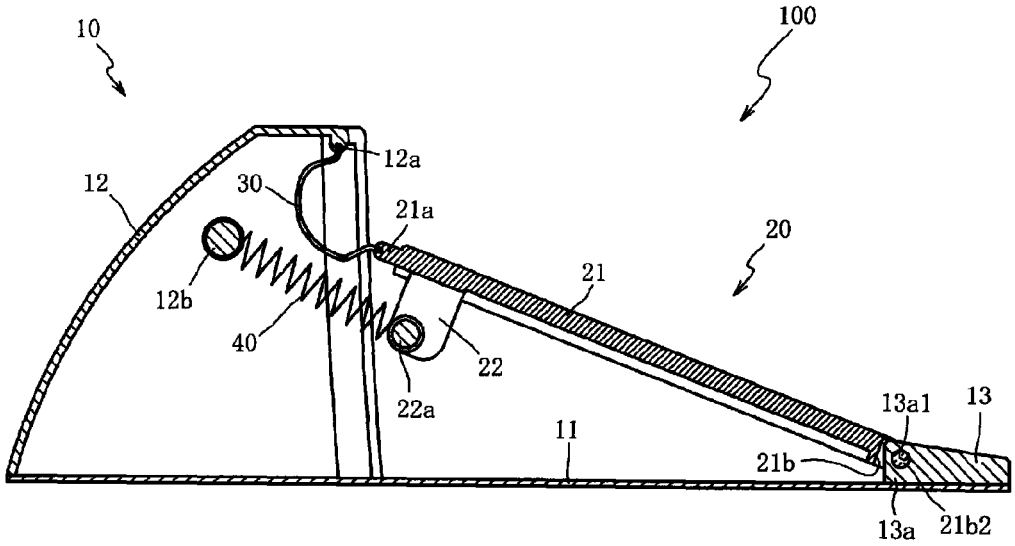
FIG. 2( a )
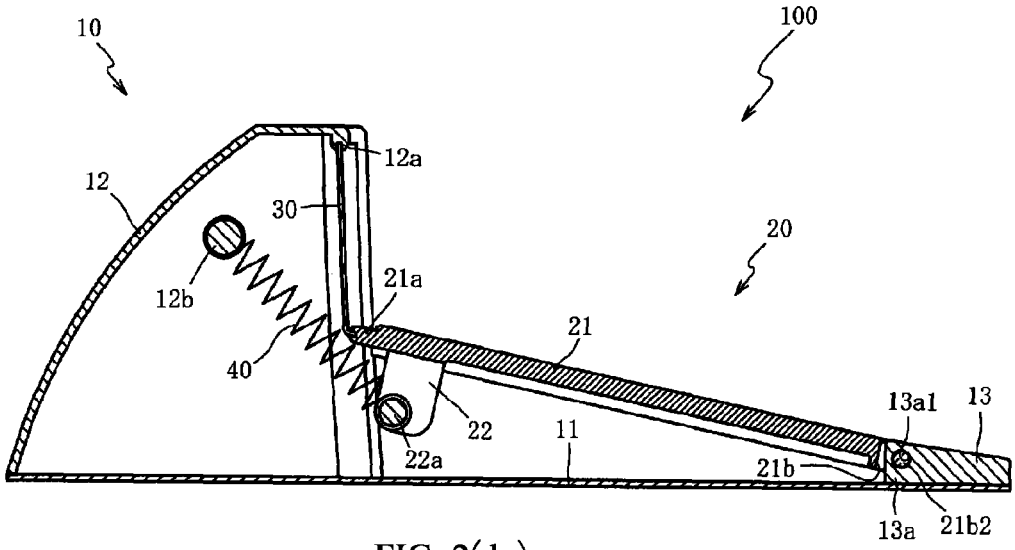
FIG. 2( b )

PEDAL APPARATUS

CROSS-REFERENCE TO RELATED PATENT APPLICATIONS

Japan Priority Application 2010-176471, filed Aug. 5, 2010 including the specification, drawings, claims and abstract, is incorporated herein by reference in its entirety.

FIELD OF THE INVENTION

The present invention relates to a pedal apparatus. Particular embodiments of the present invention relate to a pedal apparatus with which the sound that is produced at the time of operation can be suppressed.

BACKGROUND

For some time, electronic percussion instruments or percussion instruments used for practice have been configured to reproduce the sensation of striking the head of an acoustic bass drum with a beater attached to a foot pedal. For example, U.S. Pat. No. 4,817,485 describes a pedal operated type drum (a pedal apparatus) that has a pedal 14, a hammer 18, and an anvil 26. The hammer 18 is moved rotationally with the treading of the pedal 14. The anvil 26 is impacted when the hammer 18 is rotationally moved. With this pedal operated drum, when the pedal 14 is stepped on, the hammer 18 impacts the anvil 26 and the rotational movement of the hammer 14is limited. As a result, the displacement of the pedal 14 is limited. Because the hammer 18 is made to impact on the anvil 26, which limits the displacement of the pedal 14 that has been stepped on by the performer, the sensation of a beater striking the head of an acoustic drum can be reproduced.

With previous pedal operated electronic or practice drums as discussed above, the displacement of the pedal is limited due to the fact that the hammer 18 and the anvil 26 are made to impact and, as a result, an undesired acoustic striking sound can be generated by the impact of the hammer 18 and the anvil 26.

SUMMARY OF THE DISCLOSURE

Embodiments of the present invention provide a pedal apparatus with which the undesired acoustic sound that is produced at the time of operation is suppressed.

In a pedal apparatus according to an embodiment of the present invention, a linking member that links a pedal and a main body section is tensioned when a performer steps on the pedal. Accordingly, the displacement of the pedal can be limited by the tensile force of the linking member, as the linking member is tensioned. Therefore, it is possible to avoid generating an acoustic striking sound of bodies impacting against each other. Accordingly, embodiments of the present invention can provide an advantageous result that undesired acoustic sound produced at the time of operation of the pedal apparatus can be suppressed.

In a further example of a pedal apparatus according to the above embodiment of the present invention, the linking member is configured from an elastic material. As a result, when the pedal is stepped on, the linking member can be made to be tensioned while elastic deformation of the linking member is produced. Accordingly, the elastic restoring force of the linking member is made to act on the pedal. Therefore, the linking member can reproduce a force consistent with the typical force that normally pushes back a beater at the time that the beater strikes a head of a bass drum, which is caused by the tension of the head. Accordingly, embodiments of the present invention can provide an advantageous result of reproducing the sensation of a beater striking the head of a bass drum, for example, by configuring the linking member as an elastic member.

In a further example of a pedal apparatus according to any of the above-described embodiments of the present invention, the linking member is entrained by the entraining member, such that a length of the linking member between two ends of the linking member is made to curve, to change the handling direction. Therefore, the linking member may be arranged in a position to have a degree of freedom. Accordingly, embodiments of the present invention can provide an advantageous result of arranging a relatively long linking member in a limited space, while minimizing the size of the pedal apparatus.

In a further example of a pedal apparatus according to any of the above-described embodiments of the present invention, the entraining member is pivotally supported on the main body section, to allow rotation of the entraining member. As a result, when the pedal is stepped on and the linking member is stretched, the entraining member is made to rotate and the frictional resistance between the linking member and the entraining member can be made small. Accordingly, embodiments of the present invention can provide an advantageous result of minimizing wear on the linking member and the entraining member; and, in addition, the displacement of the linking member can be made smooth.

In a further example of a pedal apparatus according to the above-described embodiment of the present invention, the pedal apparatus is furnished with a fixing entraining member and a mass body. A central portion of the linking member is fixed by the fixing entraining member and is coupled for rotation to the treading of the pedal. The mass body is a weight that is linked to the fixing entraining member. As a result, when the pedal is stepped on, the fixing entraining member is rotated, and the mass body that has been linked to the fixing entraining member is displaced in the direction that is against the direction of the force of gravity. Accordingly, the load that is required in order to raise the mass body against gravity is made to act on the pedal. Accordingly, embodiments of the present invention can provide an advantageous result of reproducing the inertial force that acts when a foot pedal on which a beater had been mounted has been stepped on.

In addition, embodiments of the present invention can provide an advantageous result of biasing by the biasing member in the direction that is opposite the direction that the pedal is stepped on; and, also, use the displacement of the mass body in the direction of the force of gravity (the mass body drops down due to the force of gravity) to quickly return the pedal to the position prior to being stepped on, upon releasing the pedal.

In a further example of a pedal apparatus according to any of the above-described embodiments of the present invention, a buffering member is positioned on the displacement path that the linking member takes when the linking member is tensioned from a relaxed state, upon treading of the pedal. The buffering member is configured from an elastic material. Accordingly, when the linking member is tensioned from a relaxed state, the buffering member is pressed by the linking member that has been tensioned. Thus, embodiments of the present invention can provide an advantageous result of dampening the impact when the pedal is stepped on by action of the elastic restoring force of the buffering member. In particular, the buffering member is positioned in the displacement path of the linking member, such that the buffering member is pressed by the linking member when it is displaced along the displacement path due to being tensioned from a relaxed state. The linking member may be stretched to a linear form by the tensioning. As a result, the force component in the direction that the buffering member presses (the direction that is perpendicular to the linking member) becomes small with respect to the force component in the direction that the linking member is tensioned (the direction that the linking member is made to stretch). Accordingly, embodiments of the present invention provide an advantageous result that since the load that is imposed on the buffering member can be made small, the buffering member may last longer and be more durable.

In a further example of a pedal apparatus according to any of the above-described embodiments of the present invention, the pedal apparatus is furnished with a sensor that detects the state at which the pedal is stepped on. Accordingly, embodiments of the present invention provide an advantageous result that the sensor detects the state at which the pedal is stepped on and a detection signal can be used in an electronic percussion instrument system that, based on the detection signal, generates a musical tone in conformance with the preferences of the performer.

BRIEF DESCRIPTION OF THE DRAWINGS

FIG. 1(*a*) is a perspective view of a pedal apparatus according to a first embodiment of the present invention.

FIG. 1(*b*) is a top view of the pedal apparatus of the first embodiment of the present invention;

FIG. 2(*a*) is a cross section view of the pedal apparatus along the line IIa-IIa of FIG. 1(*b*);

FIG. 2(*b*) is another cross section view of the pedal apparatus along the line IIa-IIa of FIG. 1(*b*);

FIG. 4(*b*) is a cross section view of the pedal apparatus of the second embodiment, along the line IVb-IVb of FIG. 4(*a*);

FIG. 5(*b*) is another side view of the pedal apparatus of the second embodiment.

DETAILED DESCRIPTION

Figure 3:
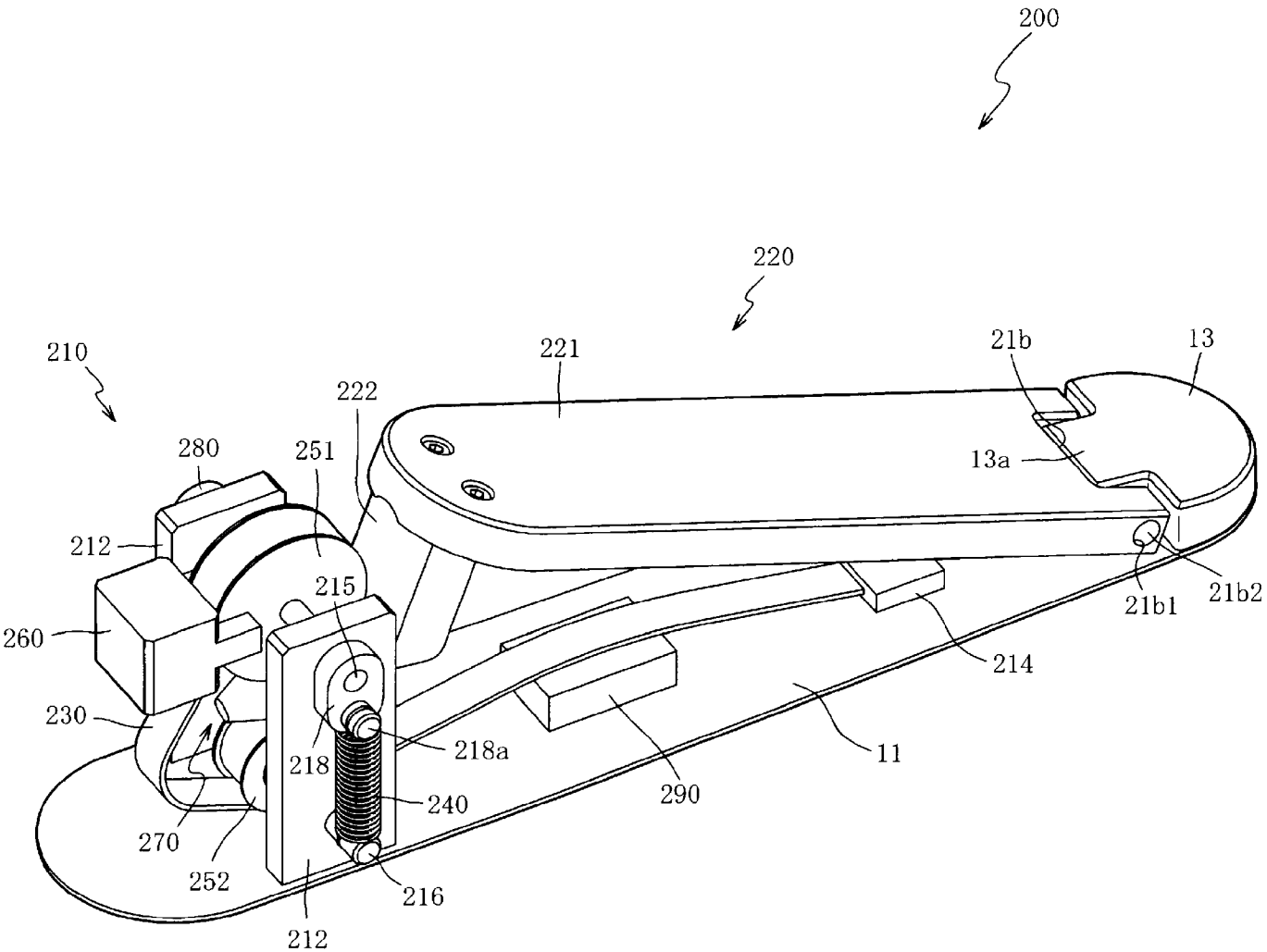
FIG. 3 is a perspective view of a pedal apparatus of a second embodiment.

An explanation will be given below regarding preferred embodiments of the present invention while referring to the attached drawings. First, an explanation will be given regarding the configuration of a pedal apparatus 100 of a first embodiment referring to FIG. 1 and FIG. 2. FIG. 1(*a*) is perspective view of the pedal apparatus 100 of the first embodiment of the present invention, and FIG. 1(*b*) is a top view of the pedal apparatus 100. FIG. 2(*a*) is a cross section view of the pedal apparatus 100, along the line IIa-IIa of FIG. 1(*b*), and shows the state prior to stepping on the pedal 20. FIG. 2(*b*) is another cross section view of the pedal apparatus 100, along the line IIa-IIa of FIG. 1(*b*), and shows the state in which the pedal 20 has been stepped on. In FIG. 2(*a*) and FIG. 2(*b*), the main body section 10 and the linking section of the pedal 20 and the belt 30 are shown schematically in the drawings.

As is shown in FIGS. 1(*a*) and 1(*b*), the pedal apparatus is a foot pedal for practice that simulates to a user the sensation or feeling of a foot pedal that strikes the head of an acoustic drum with a beater. The pedal apparatus 100 is provided with a main body 10, a pedal 20, a band-shaped belt member 30, and a spring-shaped spring member 40 (shown in FIGS. 2(*a*) and 2(*b*)). The pedal 20 is pivotally supported and able to pivot on the main body 10. The belt member 30 is linked to the main body section 10 and the pedal 20. The spring member 40 is linked to the main body section 10 and the pedal 20.

The main body 10 is provided with an oval plate-shaped bottom section 11 that is configured to be placed on the ground (or flat surface). The main body 10 is also provided with an upright section 12 and a pedal mounting section 13. The upright section 12 is disposed upright (when the bottom section 11 is placed on the ground or flat surface) and extends upward from one side, in the long direction, of the bottom section 11 (the left side in FIG. 1(*b*)). The pedal mounting section 13 is mounted on the other side, in the long direction, of the bottom section 11 (the right side in FIG. 1(*b*)).

One end of the belt member 30 and one end of the spring member 40 are linked to the upright section 12. The upright section 12 covers one side, in the long direction, of the bottom section, and leaves an empty volume between the upright section 12 and the bottom section 11. In addition, the upright section 12 provides an opening that faces toward the other side, in the long direction, of the bottom section 11. In addition, the upright section 12 is provided with a first belt fastening section 12*a* and a first spring linking section 12*b*. The first belt fastening section 12*a* is formed on the inner peripheral surface of the upright section 12. The first spring linking section 12*b* extends between and links two inner side surfaces of the upright member 12 to each other. The first belt fastening section 12*a* is a component that fastens one end of the belt member 30. The first belt fastening section 12*a* is a protrusion extending from the upper part of the upright member 12 (the top in FIG. 1(*a*)) toward the lower part (the bottom in FIG. 1(*a*)). The first spring linking section 12*b* is a rod-shaped member to which one end of the spring member 40 is linked. The first spring linking section 12*b* is arranged with its long dimension roughly parallel to the direction of the width of the bottom section 11 (the direction of the width in FIG. 1(*b*)). An example of a method by which one end of the belt member 30 is fastened to the first belt fastening member 12*a* includes sandwiching one end of the belt member 30 between the first belt fastening member 12*a* and a metal member, and clamping and fixing the metal member to the first belt fastening member 12*a* by a bolt. Alternatively, a further example method by which one end of the belt member 30 is fastened to the first belt fastening member 12*a* includes adhering the end of the belt member 30 to the first fastening member 12*a*.

The pedal 20 is pivotally supported by the pedal mounting section 13 and is able to swing freely. The pedal mounting section 13 is provided with a projecting member 13 that is arranged to protrude toward one side in the long direction of the bottom section 11. A pass-through hole 13*a*1 (shown in FIGS. 2(*a*) and 2(*b*)) is disposed through the projecting section 13*a*, along the direction of the width of the bottom section 11.

The pedal 20 is arranged to swing when stepped on by a performer. The pedal 20 is provided with the treading section 21 and the protruding section 22 (shown in FIGS. 2(*a*) and 2(*b*)). The protruding section 22 (shown in FIGS. 2(*a*) and 2(*b*)) is attached to the treading section 21 and protrudes in the direction that the treading section 21 is stepped on (the downward direction in FIG. 1(*b*)).

The treading section 21 is arranged to be stepped on by the performer. The treading section 21 is provided with a second belt fastening section 21*a* and a recessed section 21*b*. The second belt fastening section 21*a* is formed on one side or end of the treading section 21, in the long direction (the left side in FIG. 1(*b*)). The recessed section 21*b* is provided on the other side or end of the treading section 21, in the long direction (the right side in FIG. 1(*b*)). The other end of the belt member 30 is fastened to the second belt fastening section 21*a*. The second belt fastening section 21*a* protrudes toward one side, in the long direction, of the main body section 10 (the left side in FIGS. 2(*a*) and 2(*b*)).

The recessed section 21*b* is formed such to receive at least a portion of a projecting section 13*a*, which is formed on the pedal mounting section 13 of the main body section 10 and fits within the recessed section 21*b*. In addition, insertion holes 21*b*1 are formed to pass through the treading section 21, along the direction of the width of the treading section 21. The insertion holes 21*b*1 are formed in the portions of both sides of the treading section 21, in the direction of the width of the treading section 21, that are on either side of the recessed section 21*b* (the top and the bottom in FIG. 1(*b*)). The insertion holes 21*b*1 are formed in a position to align with a pass-through hole 13*a*1 formed in the projecting section 13*a*, when the projecting section 13*a* of the pedal mounting section 13 has been fitted into the recessed section 21*b* of the treading section 21. A shaft-shaped pedal pivot section 21*b*2 is placed through the pass-through hole 13*a*1 and the insertion holes 21*b*1. As a result, the pedal 20 is pivotally supported on the main body section 10 and is able to swing freely.

As is shown in FIG. 2(*a*), the protruding section 22 is configured to pull the spring member 40 when the treading section 21 is stepped on. The protruding section 22 is connected to or otherwise fixed to the bottom of the treading section 21 (the bottom in FIG. 2(*a*)) by, for example, but not limited to, a bolt and a nut. An end of the spring member 40 is connected to the protruding section 22. In particular, a rod-shaped second spring linking member 22*a*, which is arranged roughly parallel to the direction of the width of the treading section 21, is provided on the protruding section 22, to connect with one end of the spring member 40.

The belt member 30 is configured to limit the displacement of the pedal 20, when the pedal 20 has been stepped on a specified amount. The belt member 30 is made from any suitable material, for example, but not limited to, rubber in which glass fibers have been embedded as a core, to add strength. In addition, the belt member 30 has one end fastened to a first belt fastening section 12*a* formed on the upright section 12 of the main body section 10. In addition, the belt member 30 has another end fastened to a second belt fastening section 12*a* that is formed on the treading section 21 of the pedal 20. When the pedal 20 is in a state, prior to being stepped on, the first belt fastening section 12*a* and the second belt fastening section 21*a* are arranged at positions relative to each other such that the length of the spacing between the first belt fastening section 12*a* and the second belt fastening section 21*a* is smaller than the length of the belt member 30, in the long dimension of the belt member 30. Accordingly, it is possible for the belt member 30 to be in a relaxed state, when the pedal 20 is in a state, prior to being stepped on.

The spring member 40 is a tension spring or other suitable tension device, for returning the pedal 20 to its state or position, prior to being stepped on, when the pedal is released from a state of being stepped on. The spring member 40 has one end connected to the first spring linking section 12*b* that is arranged on the upright section 12 of the main body section 10. In addition, the spring member 40 has another end connected to the second spring linking section 22*a* that is formed on the treading section 21 of the pedal 20. When the pedal 20 is in the state, prior to being stepped on, the first spring linking section 12*b* is positioned above the second spring linking section 22*a*. At that time, the pedal 20 is held by the spring 40 in a state in which the pedal 20 is raised up by the biasing force of the spring member 40, in the direction that is opposite the direction that the pedal 20 is stepped on (the upward direction in FIG. 2(*a*)).

A state in which the pedal 20 of the pedal apparatus 100 has been stepped on is described with reference to FIG. 2(*b*). When the treading section 21 of the pedal 20 is stepped on, the belt member 30 is pulled by the pedal 20. As a result, the belt member 30 is tensioned, while being subjected to elastic deformation from a relaxed state, and displaced to a linear form. If the pedal 20 is again stepped on from that state, the displacement of the pedal 20 is limited by the tensile force of the belt member 30.

Therefore, it is possible to limit the displacement of the pedal 20 by the tensile force of the belt member 30. Accordingly, embodiments of the present invention may avoid the generation of a striking sound that would otherwise be produced if the displacement of the pedal 20 were, instead, limited by the impacting of bodies against each other. As a result, the generation of an acoustic sound by the operation of the pedal apparatus 100 can be suppressed.

Embodiments of the belt member 30 are configured from an elastic material. As a result, it is possible for the belt member 30 to be tensioned, while producing elastic deformation. Accordingly, the elastic restoring force of the belt member 30 can be made to act on the pedal 20. Therefore, it is possible to simulate and reproduce a force similar to the force that pushes back the beater due to the tension of the head when the head of a bass drum is struck by the beater. In other words, the sensation when the head of a bass drum is struck by the beater can be simulated and reproduced.

Moreover, compared to the case in which the displacement of the pedal is limited by having bodies impact each other, it is not necessary to provide a member for making an impact and it is not necessary to provide a mechanism for the two bodies to strike each other. Accordingly, the component cost of the pedal device or instrument system can be reduced; and, in addition, it is possible to downsize and simplify designs aspects for the pedal apparatus 100.

Figure 4A:
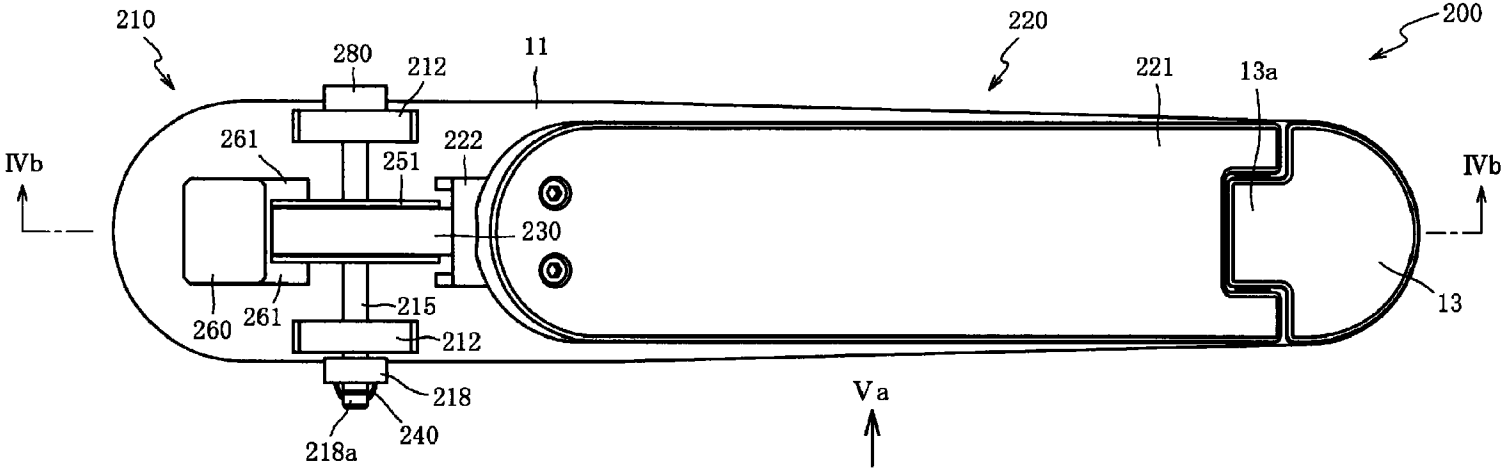
FIG. 4(*a*) is a top view of the pedal apparatus of the second embodiment.
Figure 4B:
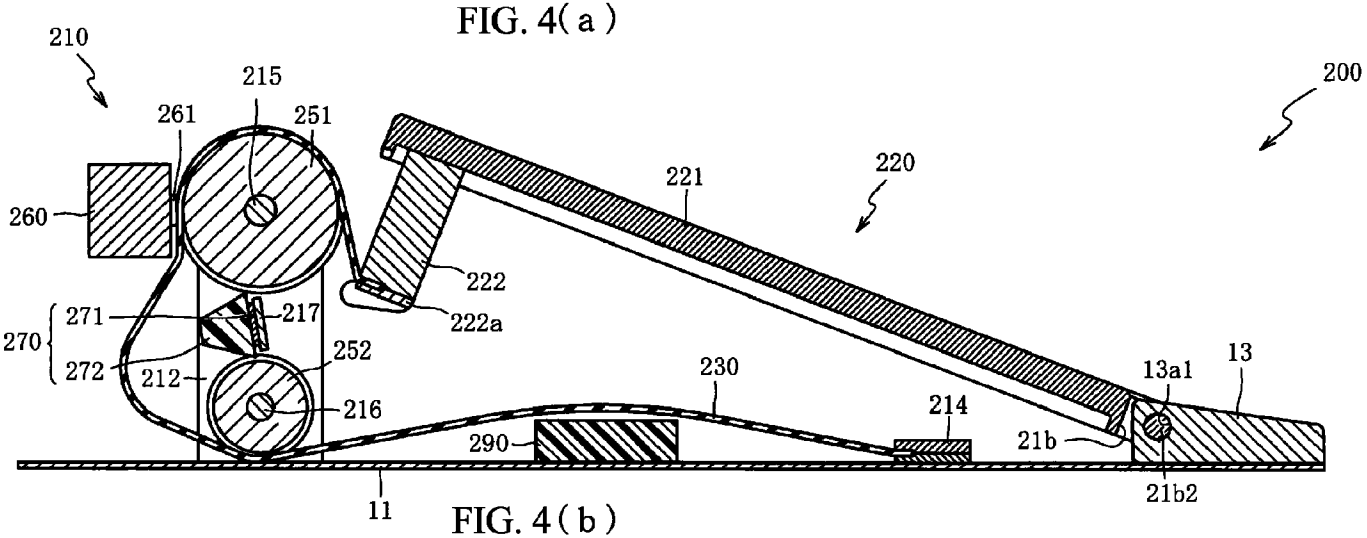
Figure 5A:
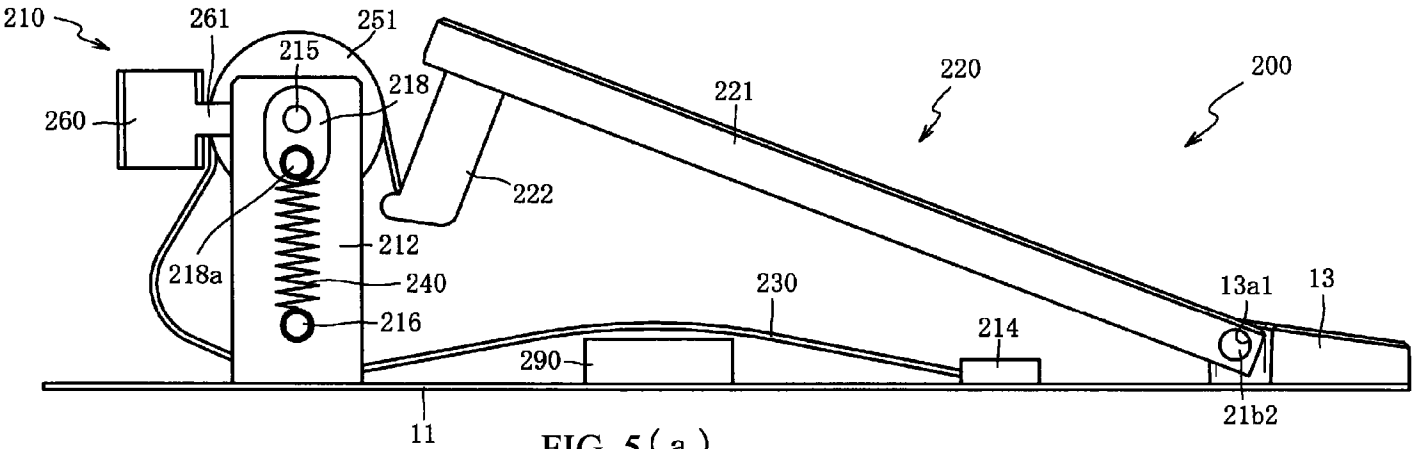
FIG. 5(*a*) is a side view of the pedal apparatus of the second embodiment.
Figure 5B:
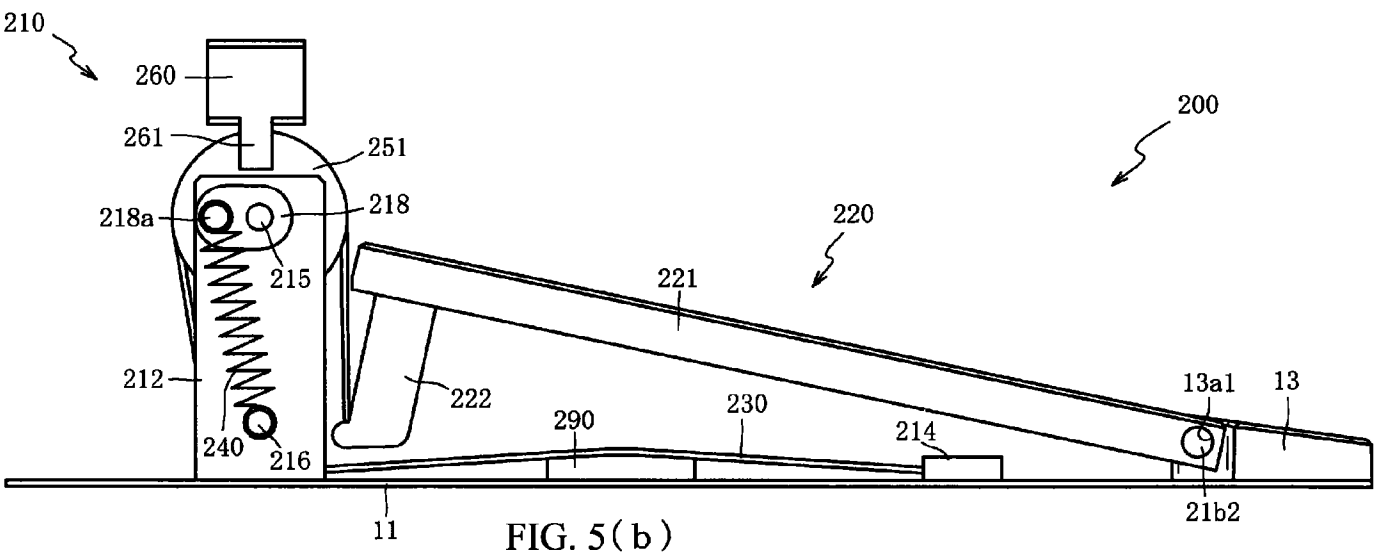
Figure 6:
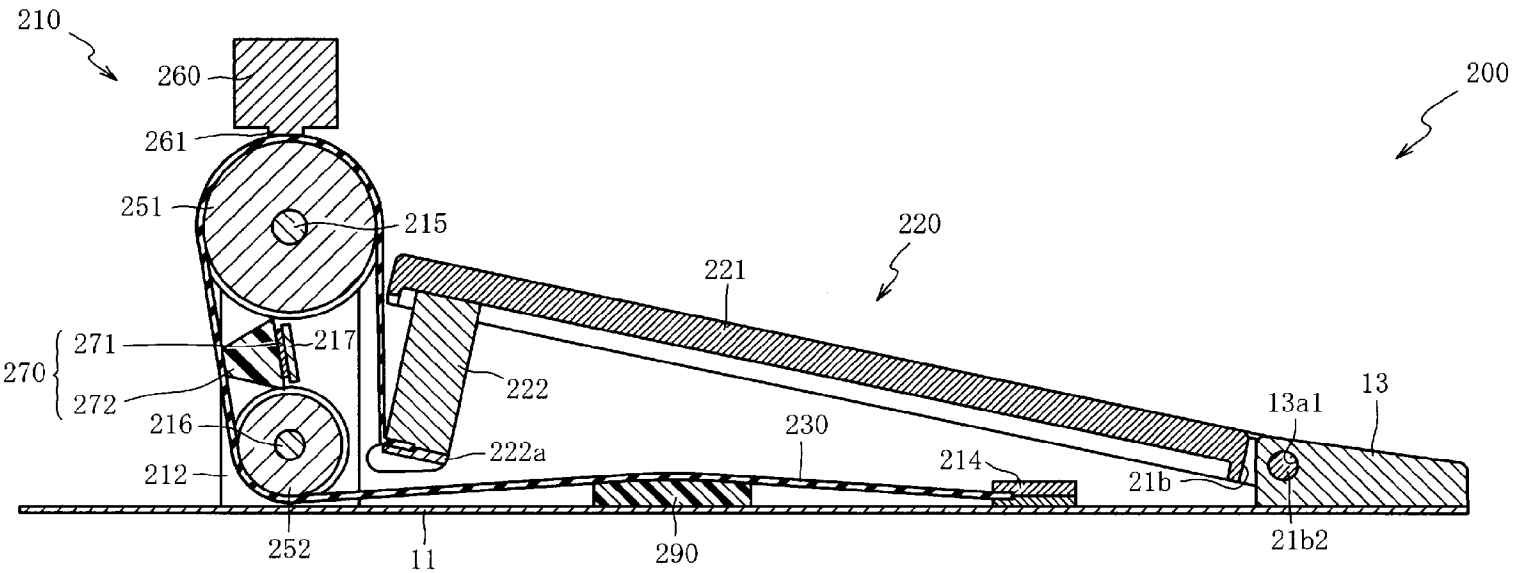
FIG. 6 is a cross section view of the pedal apparatus of the second embodiment, along the line IVb-IVb of FIG. 4(*a*).

A pedal apparatus according to a second embodiment is described with respect to the pedal apparatus 200. In the first embodiment discussed above, a pedal apparatus 100 may be a foot pedal that is used for practice and that simulates the foot pedal that strikes the head of an acoustic drum with a beater. According to the second embodiment, the pedal apparatus 200 is used as an electronic musical instrument that produces a musical tone in conformance with the treading of the pedal 220. A configuration of the pedal apparatus 200 is described with reference to FIG. 3 through FIG. 6. FIG. 3 shows a perspective view of the pedal apparatus 200 according to the second embodiment. FIG. 4(*a*) is a top view of the pedal apparatus 200. FIG. 4(*b*) is a cross section view of the pedal apparatus 200, along the line IVb-IVb of FIG. 4(*a*), in a state prior to being stepping on. FIG. 5(*a*) is a lateral side view of the pedal apparatus 200, in a state prior to being stepping on. FIG. 5(*b*) is a lateral side view of the pedal apparatus 200, in a state in which the pedal 220 is being stepped on. FIG. 6 is a cross section view of the pedal apparatus 200 along the line IVb-IVb of FIG. 4(*a*), in a state in which the pedal 220 is being stepped on. Parts having the same reference character as parts described above with respect to the first embodiment are the same or similar to those described above and their descriptions are incorporated herein by reference.

As is shown in FIG. 3, embodiments of the pedal apparatus 200 are configured as an electronic musical instrument with which a musical tone is produced in conformance with the treading and, in addition, simulates the feel of a foot pedal that strikes the head of an acoustic drum with a beater. The pedal apparatus 200 has a main body section 210, a pedal 220, a band-shaped belt member 230, a spring-shaped spring member 240, a first entraining member 251, a second entraining member 252, a mass body 260, a first sensor 270, a second sensor 280, and a buffering member 290. The pedal 220 is supported pivotally on the main body section 210, for pivotal or swinging motion relative to the main body section 210. The belt member 230 is connected to the main body section 210 and to the pedal 220. The spring member 240 is attached to the main body section 210. The first entraining member 251 is supported pivotally on the main body section 210, for rotational motion relative to the main body section 210. The second entraining member 252 is supported pivotally on the main body section 210, next to the first entraining member 251 (below in FIG. 3), for rotational motion relative to main body section 210. The mass body 260 is connected to the first entraining member 251. The first sensor 270 is arranged between the first entraining member 251 and the second entraining member 252 and is configured to detect the state of the belt member 230. The second sensor 280 is attached to the main body section 210 and detects the rotation of the first entraining member 251. The buffering member 290 is attached to the main body section 210, below the pedal 220.

As is shown in FIG. 4(*a*) or FIG. 4(*b*), the main body section 210 has a bottom section 11, a pair of upright sections 212, a pedal mounting section 13, a first belt fastening section 214, a first pivot section 215, a second pivot section 216, a holding member 217, and a rotating member 218. The upright sections 212 are disposed upright on the bottom section 11. The first belt fastening section 214 is attached to the bottom section 11, between the upright sections 212 and the pedal mounting section 13. One end of the belt member 230 is fastened in the first belt fastening section 214. The first pivot section 215 is arranged to extend through the pair of upright sections 212. The second pivot section 216 is arranged to extend through the pair of upright sections 212, next to the first pivot section 215 (below, in FIG. 4(*b*)). The holding member 217 is arranged between the first pivot section 215 and the second pivot section 216. The rotating member 218 is fastened to the first pivot section 215.

The pair of upright sections 212 are components for supporting the first entraining member 251 and the second entraining member 252, pivotally, for rotational motion relative to the upright sections. Each upright section 212 in the drawings has a generally rectangular plate shape. Each upright section 212 is arranged in parallel alignment with the other upright section 212, along the direction of the width of the bottom section 11, and is separated from the other upright section 212 by a predefined distance.

The first pivot section 215 is a rod-shaped member for allowing rotation of the first entraining member 251. The first pivot section 215 is supported pivotally on the pair of upright sections 212, for rotational motion relative to the upright sections 212. Similarly, the second pivot section 216 is a rod-shaped member for supporting the second entraining member 252 pivotally, for rotational motion. The second pivot section 216 is supported pivotally on the pair of upright sections 212, for rotational motion relative to the upright sections 212. Each of the first pivot section 215 and the second pivot section 216 have a dimension in the axial direction (the vertical direction in FIG. 4(*a*)) that is greater than the spacing distance between the pair of upright sections 212. Accordingly, when the first pivot section 215 and the second pivot section 216 are arranged to extend through the pair of upright sections 212, both ends of each of the pivot sections protrude outwardly (upward and downward in FIG. 4(*a*)) from each of the upright sections 212.

The holding member 217 is a plate-shaped member for holding the first sensor 270. The holding member 217 has a pair of side edge portions that are respectively fastened to the pair of upright sections 212 in a state in which one surface of the holding member 217 faces toward one end side, in the long direction, of the bottom section 11 (the left side in FIG. 4(*b*)). Since the first sensor 270 is held on the holding member 217 arranged between the first entraining member 251 and the second entraining member 252, it is possible to arrange the first sensor 270 in a space formed between the first entraining member 251 and the second entraining member 252. Therefore, otherwise unused space is effectively utilized, for example, to help downsize the design of the pedal apparatus 200.

The rotating member 218 is operatively connected to rotate with the treading of pedal 220, for pulling the spring member 240. The rotating member 218 is fastened to the end section of the first pivot section 215 that protrudes outward from the upright section 212 that is arranged on one side in the width dimension of the bottom section 11 (the lower side in FIG. 4(*a*)). As a result, the rotating member 218 moves rotationally, with rotation of the first pivot section 215. In addition, the rotating member 218 has a cylindrically shaped spring linking section 218*a* that protrudes from one side of the rotating member 218 (the bottom side in FIG. 4(*a*)). One end of the spring member 240 is linked to the spring linking section 218*a*. In the state prior to the pedal 220 being stepped on, the spring linking section 218*a* is positioned between the first pivot section 215 and the second pivot section 216 (refer to FIG. 5(*a*)).

The pedal 220 is configured to pivot or swing, when stepped on by a performer. The pedal 220 has a plate-shaped treading section 221 and a protruding section 222. The protruding section 222 is attached to the treading section 221. The protruding section 222 protrudes toward the direction that the treading section 221 is stepped on (the downward direction in FIG. 4(*b*)).

The treading section 221 is configured to be stepped on by the performer. The treading section 221 is formed in a semicircular shape on one end side, in the long direction (the left side in FIG. 4(*a*)). In addition, the treading section 221 has a recessed section 21*b* that forms a recess on the other side, in the long direction (the right side in FIG. 4(*b*)). The protruding section 222 is arranged to pull the belt member 230 when the pedal 220 is stepped on. A second belt fastening section 222*a*, to which the second end of the belt member 230 is fastened, is formed on the tip portion of the protruding section 222, in the protruding direction.

The belt member 230 is arranged to limit the displacement of the pedal 220 when the pedal 220 is being stepped on a specified amount. The belt member 230 is configured of any suitable material including, but not limited to, a rubber in which glass fibers have been embedded as a core in order to add strength. The belt member 230 has one end connected to the first belt fastening section 214 of the main body section 210. The belt member 230 has another end connected to the second belt fastening section 222*a* that is formed on the protruding section 222 of the pedal 220. In the state prior to the pedal 220 being stepped on, the belt member 230 is in a relaxed state.

The spring member 240 is a tension spring or other suitable tension device, for returning the pedal 220 to its state or position prior to being stepped on, when the pedal is released from a state of being stepped on. The spring member 240 has one end connected to the spring linking section 218*a* of the rotating member 218. In addition, the spring member 240 has another end linked to the end section of the second pivot section 216 (refer to FIG. 5(*a*)) that protrudes outward from the upright section 212 that is arranged on one side in the width dimension of the bottom section 11 (downward in FIG. 4(*a*)). Tension may be applied to the spring member 240 in the state prior to the pedal 220 being stepped on, for example, to help maintain the pedal 220 in a stabilized state.

The first entraining member 251 and the second entraining member 252 are arranged to entrain the belt member 230. The first entraining member 251 and the second entraining member 252 are supported pivotally on the pair of upright sections 212, for rotational motion relative to the upright sections 212. The first entraining member 251 and the second entraining member 252 each have a generally cylindrical shape and also have a flange shape formed on both ends in the axial direction of the generally cylindrical shape. In addition, each of the first entraining member 251 and the second entraining member 252 have a dimension in the axial direction of the generally cylindrical shape (the vertical direction in FIG. 4(*a*)) about equal to the width dimension of the belt member 230. With the first entraining member 251 and the second entraining member 252, it is possible to limit the displacement of the belt member 230 in the direction of the width of the belt member 230, while entraining the belt member 230 by generally cylindrically shaped portions of the entraining members.

In this manner, since the belt member 230 is entrained by the first entraining member 251 and the second entraining member 252, a portion of the belt member 230 between one end and the other end is curved and it is possible to change the handling direction of the belt member 230. Therefore, various arrangement positions of the belt member 230 are possible to provide further degrees of freedom of design. Accordingly, it is possible to arrange a relatively long belt member 230 within a limited space, for example to make the pedal apparatus 200 smaller. In addition, since the long dimension of the belt member 230 is largely pre-defined, the amount of strain on the belt member 230 at the time of tensioning can be made small. Accordingly, it is possible to improve the durability and longevity of the belt member 230.

In addition, a portion of the belt member 230, in the middle between one end and the other end, is fastened to the first entraining member 251. As a result, when the belt member 230 is displaced in conformance with the treading of the pedal 220, the first entraining member 251 is rotated with the displacement of the belt member 230. In addition, when the portion of the belt member 230 that is positioned between the first entraining member 251 and the first belt fastening section 214 is tensioned from the relaxed state, it is possible to make the tensioning of the belt member 230 smooth. The outside diameter of the first entraining member 251 (the outside diameter of the cylindrically shaped portion that entrains the belt member 230) is set such that the circumference is roughly four times the amount of the displacement of the belt member 230, when the pedal 220 is stepped on. In other words, the outside diameter of the first entraining member 251 is set to a dimension such that the angle of rotation of the first entraining member from the time before the pedal has been stepped on, to the maximum limit when the pedal is being stepped on, is roughly 90°.

The outside diameter of the second entraining member 252 is set smaller than the outside diameter of the first entraining member 251. The outside diameter of the first entraining member 251 is set to a dimension that corresponds to the amount of the displacement of the pedal 220 and the amount of the displacement of the mass body 260 when the pedal 220 has been stepped on. Because the outside diameter of the second entraining member 252 is made smaller than the outside diameter of the first entraining member 251, it is possible to downsize the design of the pedal apparatus 200.

In addition, because the second entraining member 252 is supported pivotally, for rotation, on the upright sections 212, the second entraining member rotates when the pedal 220 is stepped on and the belt member 230 is pulled. Accordingly, it is possible to make the friction resistance between the belt member 230 and the second entraining member 252 small. Therefore, wear on the belt member 230 and the second entraining member can be limited; and, in addition, it is possible for the displacement of the belt member 230 to be made smooth.

The mass body 260 is a weight for reproducing the sensation of stepping on a foot pedal on which a beater has been mounted. The mass body 260 is formed in roughly a rectangular parallelepiped shape. However, other suitable shapes may be used. In addition, a pair of mass body fastening sections 261 are fastened to one side of the mass body 260 (the right side in FIG. 4(*a*)), and are separated by a space as wide as the width dimension, in the axial direction, of the first entraining member 251. The mass body 260 is linked to the first entraining member 251 by the fastening of the mass body fastening sections 261 to two opposed ends, in the axial direction, of the entraining member 251. As a result, the mass body 260 moves rotationally with rotation of the first entraining member 251 when the treading on the pedal 220 is stepped on. In addition, the first entraining member, thus, not only entrains the belt member 230, but is also used to rotationally move the mass body 260. Therefore, by using the first entraining member to perform multiple functions, the component costs can be reduced; and, in addition, improve capabilities to design for downsizing of the pedal apparatus 200.

In a state prior to the pedal 220 being stepped on, the mass body 260 is positioned more to one side in the long dimension of the main body section 210 (the left side in FIG. 4(*b*)) of the first pivot section 215, which provides the axis of rotation of the first entraining member 251. In contrast, when the pedal 220 is in the state of being stepped on to the maximum limit, the mass body 260 is positioned above the first pivot section 215 (the top in FIG. 4(*b*)). As a result, the mass body 260 is prevented from being positioned more to the other side in the long dimension of the bottom section 11 (the right side in FIG. 4(*b*)) of the first pivot section 215 (refer to FIG. 5(*b*)).

The first sensor 270 comprises a suitable force sensor that detects the treading force when the pedal 220 has been stepped on. In an example embodiment, the first sensor 270 includes a piezoelectric sensor 271 and a cushion material 272. The piezoelectric sensor 271 is attached on one side (the left side in FIG. 4(*b*)) of the holding member 217 of the main body section 210. The cushion material 272 is attached to the piezoelectric sensor 271. The piezoelectric sensor 271 includes a piezoelectric element that provides an electrical signal representing the detection of the pressing force when the cushion material 272 has been pressed by the belt member 230, as the belt member 230 is tensioned from a relaxed state. According to an example embodiment, the cushion material 272 is a circular truncated cone-shaped member that is configured from an elastic material. The cushion material 272 is positioned in the displacement path of the belt member 230, when the portion of the belt member 230 between the first entraining member 251 and the second entraining member 252 is tensioned from a relaxed state. As a result, the belt member 230 comes into contact with the cushion material 272, when the belt member 230 is displaced from a relaxed state to a linear form, due to tensioning.

The second sensor 280 is a displacement sensor for the detection of the position of the pedal 220 when the pedal 220 has been stepped on. The second sensor 280 is attached to the upright section 212 on the other side, in the width dimension of the bottom section 11 (the top in FIG. 4(*a*)). The first pivot section 215 may extend through the second sensor 280, where the pivot section 215 protrudes outward from the upright member 212 (the top in FIG. 4(*a*)). As a result, it is possible to detect the amount of rotation of the first pivot section 215, which rotates with the treading of the pedal 220.

The buffering member 290 is for dampening the impact when the treading of the pedal is limited. In an example embodiment, the buffering member 290 is formed in roughly a rectangular parallelepiped shape from an elastic material. The buffering member 290 is attached to the bottom section 11, between the upright sections 212 and the first belt fastening section 214. The height dimension of the buffering member 290 on the bottom section 11 is set to a dimension that is higher than a virtual line that connects the lower edge of the cylindrical portion of the second entraining member 252 and the fastening position of one end of the belt member 230 to the first belt fastening section 214. Accordingly, it is possible to have the buffering member 290 arranged on the displacement path of the belt member 230, as the belt member is tensioned from a relaxed state.

In addition, because the buffering member 290 is arranged between the upright sections 212 and the first belt fastening section 214, the buffering member 290 can be arranged below the pedal 220 (the lower side in FIG. 4(*b*)). The displacement of the pedal 220 is limited by the belt member 230 such that a space is formed below the pedal 220, even in the state in which the pedal 200 has been stepped on to the maximum limit (refer to FIG. 5(*b*)). Therefore, because the buffering member 290 is arranged in that space, effective use can be made of otherwise unused space. Accordingly, it is possible to improve capabilities to design for the downsizing of the pedal apparatus 200.

An example of an operation of the pedal apparatus 200 when the pedal 220 is being stepped on is described with reference to FIG. 5 and FIG. 6. As is shown in FIG. 5(*a*) and FIG. 5(*b*), when the treading section 221 of the pedal 220 is stepped on by the performer, the portion of the belt member 230 that is positioned between the first belt fastening section 214 and the second belt fastening section 222*a* (refer to FIG. 6) is tensioned while being subjected to elastic deformation, due to being pulled by the pedal 220. When the pedal is further pressed on from that state, the displacement of the pedal 220 is limited by the tension of the belt member 230, and, therefore, acoustic sound that is generated at the time of the operation of the pedal apparatus 200 can be suppressed.

In addition, since the belt member 230 is configured from an elastic material, when the pedal 220 is stepped on, the portion of the belt member 230 that is positioned between the first belt fastening section 214 and the second belt fastening section 222*a* can be tensioned while being subjected to elastic deformation. Accordingly, the elastic restoring force of the belt member 230 can be made to act on the pedal 220. Therefore, it is possible to reproduce a force similar to the force that pushes back the beater due to the tension of the head when the beater strikes the head of a bass drum. Accordingly, embodiments of the invention can simulate and reproduce the sensation of the head of a bass drum being struck by a beater.

In addition, when the pedal 220 is pulled by the belt member 230 due to the treading of the pedal 220, the first entraining member 251, to which the belt member 230 is fastened, rotates in one direction (the clockwise direction in FIG. 5(*b*)). As a result, the pivot section 215, which is fastened to the first entraining member 251, rotates in one direction with rotation of the first entraining member 251. In addition, the rotating member 218, which is fastened to the end section of the first pivot section 215 is moved rotationally with rotation of the first pivot section 215. In that regard, the first entraining member 251, the first pivot section 215, and the rotating member 218 are each operatively coupled to rotationally move with the treading of the pedal 220.

The rotating member 218 moves rotationally in one direction with the treading of the pedal 220. As a result, the spring member 240, which has one end linked to the spring fastening section 218*a* of the rotating member 218, is pulled. Therefore, when the treading of the pedal 220 is released, the rotating member 218 is moved rotationally in the other direction (the counterclockwise direction in FIG. 5(*b*)), due to the biasing from the spring member 240. As a result, the first pivot section 215 and the first entraining member 251 can be made to rotate with the rotational movement of the rotating member 218. In addition, the belt member 230 can be pulled in the direction that is opposite the direction that the pedal 220 is stepped on, to return the pedal 220 to the position prior to being stepped on.

When the first pivot section 215 is rotated with the treading of the pedal 220, the amount of the rotation of the first pivot section 215 is detected by the second sensor 280 (refer to FIG. 4). Accordingly, the position of the pedal 220 may be detected. As a result, an open playing procedure can be detected where, after the detection by the second sensor 280 of the first pivot section 215 being rotated to the maximum limit in one direction (the clockwise direction in FIG. 5(*b*)) due to the pedal being stepped on, the sensor then detects the first pivot section 215 immediately rotating in the other direction (the counterclockwise direction in FIG. 4(*b*)). Open playing is a performance method in which the beater is released from the head immediately after the head of the bass drum has been struck by the beater. In addition, a closed playing procedure can be detected where, after the detection by the second sensor 280 of the first pivot section 215 being rotated to the maximum limit in one direction, the sensor does not detect the first pivot section 215 being rotated in the other direction within a specified period of time. Closed playing is a performance method in which the beater continues to press on the head even after the head of the bass drum has been struck by the beater. Accordingly, the musical tone that is produced by the performance of the pedal apparatus 200 can be processed to provide the effect of using open playing or closed playing, depending upon the detection of an open playing or closed playing procedure.

As is shown in FIG. 6, when the belt member 230 is tensioned from a relaxed state due to the pedal 220 being stepped on, the belt member 230 is displaced and the portion of the belt member 230 that is positioned between the first entraining member 251 and the second entraining member 252 is tensioned to a linear form. As a result, the belt member 230 comes into contact with the cushion material 272 of the first sensor 270 that is positioned in the displacement path of the belt member 230.

The force of the pressure of the belt member 230 that acts on the cushion material 272 can be detected by the piezoelectric sensor 271. The greater the force with which the pedal 220 is stepped on, the more rapid the displacement speed of the belt member 230 becomes, and the force of the pressure at the time that the belt member 230 comes into contact with the cushion material 272 increases in relation to that speed. As a result, the force of the pressure that is transmitted from the belt member 230 via the cushion material 272 is detected by the piezoelectric sensor 271, to produce a detection signal to transmit to a sound source device (not shown in the drawing). The sound source device can use the detection signal to produce a musical tone that corresponds to the treading force when the pedal 220 is being stepped on.

In this manner, the first sensor 270 detects the force of the pressure due to the displacement of the belt member 230 when the pedal 220 is being stepped on, and a musical tone can be produced based on the detection results. Accordingly, acoustic sound of impacting bodies can be suppressed, in contrast to systems that use sensors to detect the vibrations of the bodies that have been made to impact against each other. Therefore, embodiments of the pedal apparatus 200 can be made to suppress the acoustic sound that is generated when the pedal apparatus 200 is operated.

In addition, the mass body 260 is positioned on one side of the first pivot section 215, in the long dimension (the left side in FIG. 6) of the bottom section 11 (refer to FIG. 5(*a*)). When the pedal 220 is stepped on, the first entraining member 251 is rotated in one direction (the clockwise direction in FIG. 6) with movement of the pedal 220, and the mass body 260 is displaced in the direction that is opposite the direction of the force of gravity. Because the mass body 260 is lifted in the direction that is opposite to the direction of the force of gravity when the pedal 220 is stepped on, a load acts on the pedal 220, to simulate the inertial force that acts on a foot pedal on which a beater has been mounted, when the foot pedal is stepped on.

Moreover, when the pedal 220 is released from being stepped on, the spring member 240 biases the pedal (refer to FIG. 5(*b*)) in the direction that is opposite the direction that the pedal 220 is stepped on. In addition, the displacement in the direction of the force of gravity of the mass body 260 (as the mass body 260 drops due to the force of gravity) is utilized; and the pedal 220 can be quickly returned to its position prior to being stepped on. In addition, when the pedal 220 is stepped on, the mass body 260 is prevented from being moved to the other side of the first pivot section 215 (the right side in FIG. 6) in the long dimension of the bottom section 11. Therefore, when the pedal is released from being stepped on, the force of gravity does not act on the mass body 260 to rotate the first entraining member 251 in one direction (the clockwise direction in FIG. 6).

In addition, when the pedal 220 is stepped on, the portion of the belt member 230 that is positioned between the second entraining member 252 and the first belt fastening section 214 is displaced from a relaxed state, to a linear form while being tensioned. As a result, the buffering member 290 that is arranged in the displacement path of the belt member 230 is pressed by the belt member 230. Therefore, it is possible to dampen the impact when the pedal 220 is stepped on by the elastic restoring force of the buffering member 290.

The buffering member 290 is positioned on the displacement path of the belt member 230 when the portion of the belt member 230 that is positioned between the second entraining member 252 and the first belt fastening section 214 is tensioned from a relaxed state. The buffering member 290 is pressed by the belt member 230 when it is tensioned from a relaxed state to displace the belt member 230 into a linear form by tensioning. The force component in the direction that the belt member 230 presses against the buffering member 290 is small with respect to the force component in the direction that the belt member 230 is tensioned. The belt member 230 is tensioned in the long direction (the left to right direction in FIG. 6) of the portion of the belt member 230 that is positioned between the second entraining member 252 and the first belt fastening section 214. In contrast, the direction that the buffering member 290 is pressed is in the thickness direction (the up and down direction in FIG. 6) of the portion of the belt member 230 that is positioned between the second entraining member 252 and the first belt fastening section 214. Therefore, it is possible to make the load on the buffering member 290 relatively small. Accordingly, the durability and longevity of the buffering member 290 can be enhanced.

In addition, the buffering member 290 is a separate member arranged separately relative to the cushion material 272 of the first sensor 270. Therefore, the buffering member 290 can be configured from a different elastic material than that of the cushion material 272. Accordingly, it is possible for the cushion 272 to be selected to have an elastic force that is different from and independent of the elastic force of the buffering member 290. Accordingly, the impact when the pedal 220 is stepped on can be reliably dampened by adjusting or selecting the elastic force of the buffering member 290, while maintaining the sensitivity of the piezoelectric sensor 271 of the first sensor 270 by adjusting or selecting the elastic force of the cushion material 272.

An explanation of the present invention has been given above based on example embodiments; but the present invention is in no way limited to the example embodiments described above, but also includes various improvements and modifications that do not deviate from and are within the scope of the purport of the present invention.

For example, while embodiments described above include a belt member 30 and 230 that is configured from rubber that has had glass fibers embedded as a core for strengthening, other embodiments may employ other suitable belt member materials. For example, the belt member 30 and 230 may also be configured from an elastic body such as rubber and the like that does not have core fibers embedded for strengthening. Alternatively or in addition, the belt may also be configured from a belt of leather or metal, a chain or links, and the like.

In addition, while example embodiments described above employ a belt member 30 and 230 that is formed in a band shape, other embodiments may employ other suitably shaped belt members. For example, the belt member may be formed in a string shape.

Also, while example embodiments described above employ a tension spring as the spring member 40 and 240, other embodiments may employ other suitable tensioning members. For example, the spring member 40 and 240 may be configured from an elastic body such as rubber and the like. In such cases where a spring or an elastic body is used, the spring member is arranged between the pedal 20 and 220 and the main body 10 and 210. As a result, the spring member is subject to elastic deformation in conformance with the pedal 20 and 220 being stepped on, and the pedal 20 and 220 is pushed back by the elastic restoring force.

While the second embodiment is described above as using a belt member 230 configured from a single member, in other embodiments, other suitable belt member structures may be employed. In other words, the belt member 230 may also be configured from two or more members. For example, one belt member may be linked to the first belt fastening section 214 and the first entraining member 251 and, in addition, a second belt member may be linked to the first entraining member 251 and the second belt fastening section 222*a*. In this case, either both or only the second belt member is configured from an elastic material. Where only the second belt member is configured from an elastic material, it is possible to maintain the strength with respect to the pulling of the first belt member and to limit the damage to that belt member, while reproducing the sensation of performing on a bass drum.

While the second embodiment described above employs one second entraining member 252 other embodiments may employ two or more second entraining members 252 or, alternatively, no second entraining member 252. By furnishing two or more entraining members 252, it is possible to increase the degrees of freedom for designing the path of the belt member 230. Therefore, the pedal apparatus 200 can be designed for a downsized configuration.

While the second preferred embodiment described above employs a second entraining member 252, which is fastened to the second pivot section 216, that is supported pivotably on the pair of upright sections 212 for rotation, other embodiments may employ other suitable configurations for supporting the second entraining member 252. For example, the second entraining member 252 may be fastened and fixed to the pair of upright sections 212. As a result, the mechanism for making the second entraining member 252 rotate would become unnecessary and may be omitted, for example, to simplify the structure of the pedal apparatus 200.

While the second preferred embodiment described above employs a mass body 260 that is linked to the first entraining member 251, other embodiments may employ other configurations for supporting the mass body. For example, the mass body 260 may also be linked to the first pivot section 215.

While the second preferred embodiment described above employs a piezoelectric sensor 271 that detects the state of the belt member 230 as the sensor that detects the treading force of the pedal 220, other embodiments may employ other suitable sensors. For example, an acceleration sensor may be attached to the mass body 260 to detect the acceleration of the mass body 260 when the mass body 260 is displaced. The pedal 220 treading force may be calculated based on the detected results. Alternatively, or in addition, a load cell may be interposed between one end of the belt member 230 and the first belt fastening section 214 to detect the tensile force of the belt member 230 at the time of tensioning, and the pedal 220 treading force may be calculated based on the detected results.

While the second preferred embodiment described above employs a first sensor 270 that detects the treading force of the pedal 220 and a second sensor 280 that detects the treading position of the pedal 220 to detect the treading state of the pedal 220, other embodiments may employ one of the first sensor 270 or the second sensor 280.

What is claimed is:

1. A pedal apparatus for a percussion instrument comprising:

a main body section;

a plate-shaped pedal that is pivotally supported on the main body section and able to freely swing when stepped on in a first direction by a performer;

a biasing member that is interposed between the main body section and the pedal, that biases the pedal toward a direction that is opposite the first direction;

a linking member that links the pedal and the main body section and that is tensioned to limit displacement of the pedal without the pedal impacting another object, when the pedal is stepped on.

2. A pedal apparatus of claim 1 wherein the linking member is configured from an elastic material.

3. A pedal apparatus of claim 1, further comprising an entraining member attached to the main body section and arranged to entrain a portion of the linking member located between each end of the linking member.

4. A pedal apparatus of claim 2, further comprising an entraining member attached to the main body section and arranged to entrain a portion of the linking member located between each end of the linking member.

5. A pedal apparatus of claim 3, wherein the entraining member is supported pivotally for rotation relative to the main body section.

6. A pedal apparatus of claim 4, further comprising:

a mass body including a weight;

wherein the entraining member includes a fixing entraining member to which a central portion of the linking member is fixed, and that is operatively coupled to the pedal for rotation when the pedal is stepped on; and wherein the mass body is connected to the fixing entraining member for rotation in a direction opposed to gravity when the fixing entraining member is rotated when the pedal is stepped on.

7. A pedal apparatus of claim 1, further comprising:

a buffering member that is positioned within a path of displacement of the linking member when the linking member is tensioned from a relaxed state when the pedal is stepped on, the buffering member configured from an elastic material;

wherein the buffering member is pressed by the displacement of the linking member when the linking member is tensioned from a relaxed state.

8. A pedal apparatus of claim 2, further comprising:

a buffering member that is positioned within a path of displacement of the linking member when the linking member is tensioned from a relaxed state when the pedal is stepped on, the buffering member configured from an elastic material;

wherein the buffering member is pressed by the displacement of the linking member when the linking member is tensioned from a relaxed state.

9. A pedal apparatus of claim 3, further comprising:

a buffering member that is positioned within a path of displacement of the linking member when the linking member is tensioned from a relaxed state when the pedal is stepped on, the buffering member configured from an elastic material;

wherein the buffering member is pressed by the displacement of the linking member when the linking member is tensioned from a relaxed state.

10. A pedal apparatus of claim 1, further comprising a sensor supported by the main body section, the sensor configured for detecting a state at which the pedal is being stepped on.

11. A pedal apparatus of claim 2, further comprising a sensor supported by the main body section, the sensor configured for detecting a state at which the pedal is being stepped on.

12. A pedal apparatus of claim 3, further comprising a sensor supported by the main body section, the sensor configured for detecting a state at which the pedal is being stepped on.

13. A pedal apparatus of claim 1, wherein the linking member comprises a flexible member that is separate from the biasing member, and that is arranged to be in a relaxed state when the pedal is not being stepped on and in a tensioned state when the pedal is being stepped on to pivot the pedal a defined amount relative to the main body section.

14. A pedal apparatus of claim 13, wherein the linking member comprises a flexible band.

15. A pedal apparatus for a percussion instrument comprising:

a main body section;

a pedal pivotally supported relative to the main body section for swinging displacement when stepped on in a first direction by a performer;

a biasing member that biases the pedal toward a direction that is opposite the first direction;

a linking member that links the pedal and the main body section independent of the biasing member, the linking member configured to be tensioned and limit displacement of the pedal without the pedal impacting another object, when the pedal is stepped on.

16. A pedal apparatus of claim 15, wherein the linking member is configured from an elastic material.

17. A pedal apparatus of claim 15, further comprising an entraining member supported by the main body section and arranged to entrain a central portion of the linking member.

18. A pedal apparatus of claim 17, wherein the entraining member is supported pivotally for rotation relative to the main body section.

19. A pedal apparatus of claim 18, further comprising:

a mass body including a weight;

wherein the entraining member is operatively coupled to the pedal for rotation when the pedal is stepped on; and wherein the mass body is connected to the entraining member for rotation in a direction opposed to gravity when the entraining member is rotated when the pedal is stepped on.

20. A pedal apparatus of claim 15, further comprising:

a buffering member that is positioned within a path of displacement of the linking member when the linking member is tensioned from a relaxed state when the pedal is stepped on, the buffering member configured from an elastic material;

wherein the buffering member is pressed by the displacement of the linking member when the linking member is tensioned from a relaxed state.

* * * * *